US005085201A

United States Patent [19]

Tepper et al.

[11] Patent Number: 5,085,201

[45] Date of Patent: Feb. 4, 1992

[54] ARROW REST FOR ARCHERY BOWS

[76] Inventors: John E. Tepper; Timothy T. Tepper, both of P.O. Box 7, Shady Cove, Oreg. 97539

[21] Appl. No.: 616,103

[22] Filed: Nov. 20, 1990

[51] Int. Cl.[5] ..... F41B 5/22

[52] U.S. Cl. ..... 124/44.5; 124/24.1

[58] Field of Search ..... 124/44.5, 41.1, 24.1, 124/88

[56] References Cited

U.S. PATENT DOCUMENTS

| | | | |
|---|---|---|---|
| 4,324,221 | 4/1982 | Peck | 124/24.1 |
| 4,344,409 | 8/1982 | Barner | 124/24.1 |
| 4,421,092 | 12/1983 | Christian | 124/44.5 |
| 4,489,704 | 12/1984 | Troncoso, Jr. | 124/44.5 X |
| 4,569,325 | 2/1986 | Christian | 124/44.5 |
| 4,598,688 | 7/1986 | Paul | 124/44.5 |
| 4,686,956 | 8/1987 | Troncoso, Jr. | 124/44.5 |
| 4,756,295 | 7/1988 | Guzzetta | 124/44.5 X |
| 4,865,007 | 9/1989 | Saunders | 124/88 X |

*Primary Examiner*—Peter M. Cuomo

*Attorney, Agent, or Firm*—Eugene M. Eckelman; William H. Maxwell

[57] ABSTRACT

An arrow rest frame has a support frame for mounting on an archery bow. The arrow rest frame has a pair of opposing, spaced arrow rest wheels forming a cradle on which an arrow to be shot is rested. The arrow rest frame includes a resilient parallel linkage which provides downward movement of the arrow rest wheels to compensate for a downward bowed deflection in the arrow shaft. The resiliency of the parallel linkage is adjustable. The arrow rest employs small narrow tired wheels for minimum friction drag and for allowing free flight of the arrow therethrough.

18 Claims, 2 Drawing Sheets

ARROW REST FOR ARCHERY BOWS

BACKGROUND OF THE INVENTION

This invention relates to new and useful improvements in arrow rests for archery bows.

Many archery bows now in use have accessory type arrow rests attached to them above the bow shelf. These rests are intended to provide accuracy in shooting in steadying the arrow shaft when the bow is drawn. It is known in the art that the large driving forces by the bowstring on the arrow cause the arrow shaft to deflect as it is driven from the bow by the bowstring. Such deflection can be in a lateral direction or a vertical direction, or both, and causes inaccuracy of intended arrow flight if not compensated for. Prior forms of arrow rests have been proposed to cradle the arrow and stabilize it to minimize lateral deflection. Devices have also been proposed to compensate for vertical deflection. Such arrow rests have been characterized by pivoted cradles that swing downward by the force of the deflected arrow shaft engaging the same.

As this type of device compensates for the deflection, however, it is important that it does not impart other undesirable forces on the arrow. For example, arrow rests that pivot down from one point tend to shift the arrow shaft laterally and of course this takes away its lateral accuracy. In addition to throwing off the intended flight of the arrow, single point, pivotally moving arrow rests have the disadvantage that the arrow engaging portions thereof can create a friction drag because of the angle created by the pivotal movement, thus adversely affecting shooting accuracy.

A further disadvantage of prior arrow rests is that they do not operate efficiently when small shafted arrows are used. That is, it is known that the most efficient arrows are of reduced diameter so as to be lighter in weight. Such arrows thus have more narrowly spaced fletching usually comprised of three evenly spaced tail feathers. The arrow engaging portions of prior arrow rests are quite large and bulky and the closer spaced tail feathers of the reduced dimension arrows cannot move through bulky arrow rests without engaging portions of the rest, thus again reducing the velocity and/or throwing the arrow off track.

SUMMARY OF THE INVENTION

According to the present invention and forming a primary objective thereof, an arrow rest for archery bows is provided that operates efficiently to increase accuracy in the shooting of arrows and also to provide a minimum of drag on the arrows.

In carrying out the objectives of the invention, the present arrow rest includes a support frame arranged for attachment to an archery bow. The support frame supports an arrow rest frame having a pair of opposed, spaced arrow rest members which form a cradle on which an arrow to be shot is arranged to be seated. The arrow rest frame includes spring biased, longitudinal, parallel linkage means that support the arrow rest members pivotally in an upper rest position and provide downward movement of the rest members that compensates for downward deflection in the arrow shaft, whereby to support the arrow for travel in its intended flight path even though it bends under the force of the bowstring. The spring biased resilience of the parallel linkage means is adjustable to vary the force necessary to deflect the linkage means. The arrow rest members comprise a pair of wheels with small tires. These tires may comprise an O-ring type tire and importantly the width of the tire is very small so that the surface thereof creates a minimum friction drag on the arrow shaft as the arrow passes through the bow. Adjustment means are provided to vary the spacing between the arrow rest wheels. The arrow rest of the invention is also provided as an overdraw feature with a hand guard.

The invention will be better understood and additional objects and advantages will become apparent from the following description taken in connection with the accompanying drawings.

DETAILED DESCRIPTION OF A PREFERRED EMBODIMENT

Figure 1:
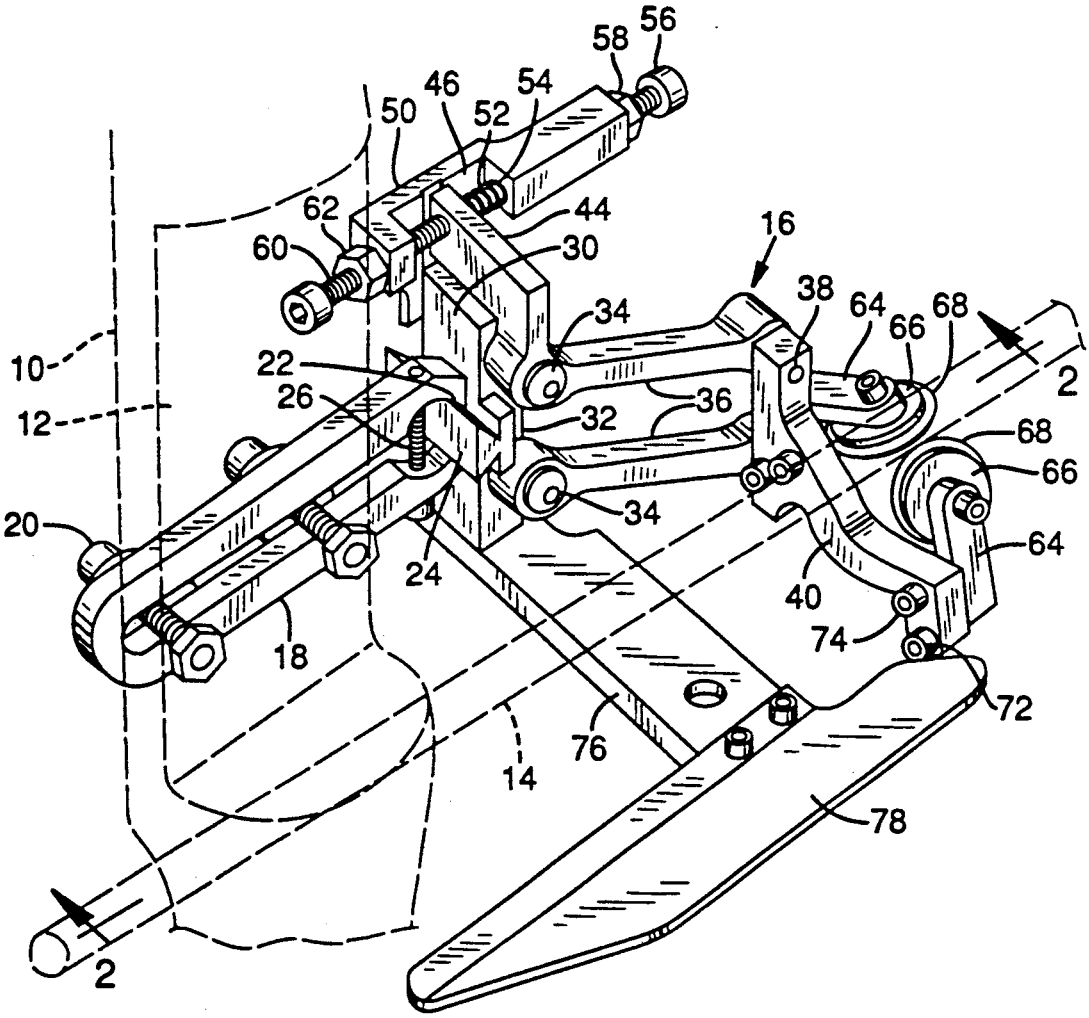
FIG. 1 is a perspective view of the present arrow rest, a fragmentary portion of an archery bow on which the device is mounted and an arrow being shown in phantom lines.

With particular reference to the drawings, the numeral 10 designates a conventional archery bow with a cutout shelf area 12. The numeral 14 designates a conventional arrow with fletching 14*a*.

Support for the present arrow rest 16 is achieved by a U-shaped bracket 18 which lies against the outer vertical surface of the bow at the shelf area 12 and is secured in a fixed position by one or more mounting means such as bolts 20 engageable in suitable bored holes in the bow and passing through the center of the U-shaped bracket 18 for longitudinal, adjustable clamped engagement. The open end 22 of the U-shaped bracket 18 is shaped to support a laterally extending dovetail base 24 for the arrow rest. This base has secured clamping engagement in the bracket 18 by clamp means such as a screw 26 and can be installed, removed or adjusted laterally after loosening of the clamp screw. The open end 22 of bracket 18 carries the dovetail base 24 horizontally so as to extend it laterally from the face of the shelf area 12 in order to position the post laterally as may be required.

Integral with the base 24 is an upright post 30 having an outwardly facing side edge 32 on which is supported a resilient parallel linkage means, by a pair of vertically aligned upper and lower pivots 34, a pair of rearwardly extending upper and lower links or arms 36, respectively. These links or arms are pivotally connected at upper and lower pivots 38 to a laterally extending carrier 40 in a parallel linkage arrangement wherein carrier 40 will maintain the same level plane in all vertical movements of said links or arms 36. As shown, the spacing of pivots 34 on post 30 is the same as the spacing of pivots 38 on laterally extending carrier 40, and the links or arms 36 are of equal lengths. A feature is the rearward extension of the parallel links or arms 36 from the post 30, whereby the carrier 40 is spaced from the bow 10 for providing a substantial overdraw configuration.

A yieldable stop means is carried on the base 24 and is comprised of an upper link or arm 36 having an integral lever arm 44 extending upwardly and laterally over the top of the post 30. The free end of this lever arm 44 projects into a cutout portion 46 of a member 50 integral with post 30 and has a resiliently biased forward movement. As shown, this bias is by means of a spring means and preferably by abutment against a compression spring 52. Spring 52 is slidably mounted in a longitudinal bore 54 in the member 50 and has rear engagement with an adjusting screw 56 mounted in a tapped bore axially aligned with the bore 54. Adjusting screw 56 carries a lock nut 58 thereon. Spring 52 allows rearward movement of lever 44 and thus downward adjusting movement of carrier 40, as will be more apparent hereinafter. An abutment screw 60 is threadedly mounted in the member 50 on the side opposite from the spring 52 and serves to stop and position return movement of the lever arm 44 under the action of the spring 52. Abutment screw 60 is adjustable and carries a lock nut 62 thereon.

Figure 3:
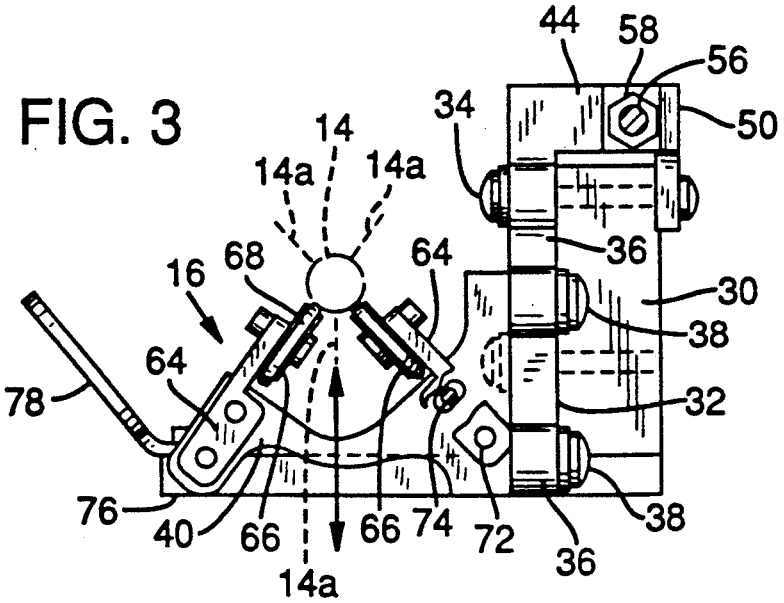
FIG. 3 is a transverse view taken on line 3—3 of FIG. 2, showing an arrow and its fletching in phantom lines.

Carrier 40 supports guide means 64 in the form of a pair of arms that angle upwardly toward each other and support small wheels 66 at the upper end thereof. Each of the wheels 66 has a narrow tire 68 on its periphery, nd as best seen in FIG. 3 these tires comprise the arrow engaging portion of the arrow rest. The angular relationship of the arms 64 is such as to provide a positive support for the arrow but also to leave a central space therebetween through which a bottom fletching 14*a* will freely pass. The arms of guide means 64 have a lower clamping pivot support 72 on the carrier 40 and furthermore have a pin and lateral slot adjusting engagement 74 with the carrier whereby upon temporarily loosening clamp pivot 72, the angle of the arms of guide means 64 can be changed to vary spacing between the tires. Such adjustment is arranged to accommodate arrows of different diameter.

In shooting an arrow, it is placed on the wheels 64 and when it is shot it moves along the wheels with minimum friction. Such minimum friction is achieved by the specific use of narrow tired wheels. These tires may comprise conventional O-rings having a smooth substantially friction free surface, thus imparting minimum frictional drag on the arrow. The arrow engaging surface of these tires can be very small, namely, twenty-five thousands or smaller.

Figure 2:
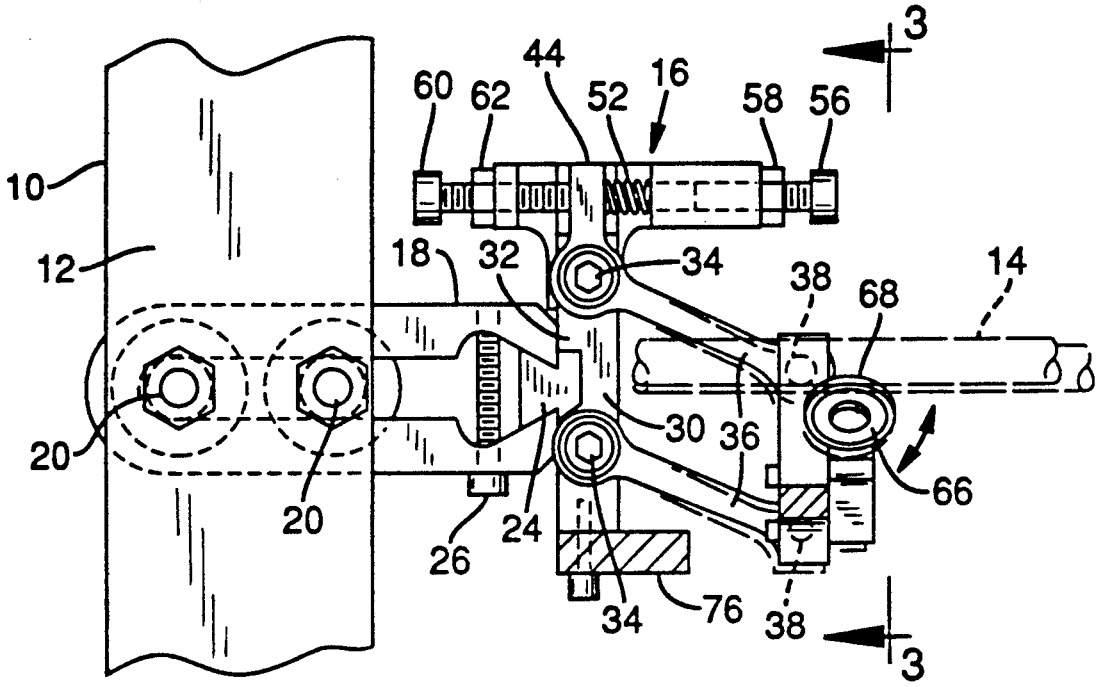
FIG. 2 is a longitudinal sectional view taken on the line 2—2 of FIG. 1, this view showing a rest position of the arrow rest member and arrow in solid lines and a deflected position thereof in phantom lines.

As the arrow is driven and accelerated by the bowstring, it will bend to the flexed phantom line shape shown in FIG. 2, and as the arrow proceeds through the bow the wheels and the supporting mechanism therefor will adjust downwardly for this deflection. Thus, the original track of the arrow is not substantially altered and it will follow its intended line of flight. Since the support of the arrow rest portion 16 is by a parallel linkage arrangement, the arrow engaging wheels move straight down and thus maintain common points of engagement with the arrow throughout the deflection. This provides a valuable improvement over a single point type pivot support since such a support changes points of engagement with the arrow as deflection occurs and can adversely affect the arrow.

Suitable rest positioning of the carrier 40 is accomplished by selected positioning of the abutment screw 60, and furthermore the resilient force of spring 52 can be varied by adjustment of screw 56. These adjustments are for fine tuning the arrow rest to accommodate the particular size and spine characteristics of arrows.

The small engaging supports for the arrow as achieved by the narrow tires 68 takes up a minimum of space in the path of the arrow fletching, and even the smallest type arrows can be used without the possibility of the fletching engaging the wheels.

Since the links or arms 36 of the parallel linkage mechanism project rearwardly from the bow, the present arrow rest also forms an overdraw for the bow, thus accomplishing the function of an overdraw in allowing shorter and lighter weight arrows to be used. The support post 30 for the arrow rest carrier supports an inwardly extending lateral arm 76 having a longitudinally extending hand guard 78 thereon. The arm 76 is disposed horizontally and well beneath the arrow shaft 14, and the guard 78 overlies the grip portion of the bow as shown in order to protect the hand and wrist of the archer.

According to the invention, an arrow rest is provided that is easily adaptable to substantially all types of archery bows and provides a rest for arrows that creates minimal drag on the arrows, and furthermore, due to the parallel linkage arrangement, maintains a uniform surface engagement with the arrow as the rest moves downward under deflection of the arrow. The device is capable of adjustment for arrows of different diameters and its structure eliminates the possibility of being struck by the fletching. Furthermore, the arrow rest comprises an overdraw and also provides a support for a hand guard.

It is to be understood that the form of our invention herein shown and described is to be taken as a preferred example of the same and that various changes in the shape, size and arrangement of parts may be resorted to without departing from the spirit of our invention or the scope of the subjoined claims.

Having thus described our invention, we claim:

1. An arrow rest arranged for use with an archery bow and arranged to support an arrow in drawn condition, said arrow rest comprising:

a support bracket arranged for attachment to a bow, an arrow rest carrier, a pair of opposing spaced arrow rest members on said arrow rest carrier and forming a cradle support on which an arrow to be shot is arranged to be seated, and resilient parallel linkage means comprised of a pair of upper and lower arms pivotally disposed on transverse horizontal axes and extending rearwardly supporting said arrow rest carrier pivotally on said support bracket, said parallel linkage means supporting said arrow rest carrier in an upper rest position and providing downward movement of said arrow rest members to compensate for a downward bowed deflection in the arrow shaft and at the same time to support the arrow in its original flight path during such downward movement, and a yieldable stop means comprised of a stop limiting upward pivoted movement of the parallel linkage means and spring means permitting yieldable downward depression thereof.

2. The arrow rest of claim 1 wherein said resilient parallel linkage means comprises a laterally extending arm, abutment means on said support bracket, and said spring means between said arm and abutment means providing the deflecting movement of said linkage means and for returning said linkage means to an original position.

3. The arrow rest of claim 2 including adjustment means engageable with said spring means arranged to vary the resilient force of said spring and thus vary the deflecting force from the arrow necessary to deflect said linkage means.

4. The arrow rest of claim 1 wherein said arrow rest members comprise a pair of wheels with peripheral tires.

5. The arrow rest of claim 4 wherein the tires on said wheels comprise O-ring substantially friction free type tires.

6. The arrow rest of claim 4 wherein the tires on said wheels comprise O-ring type tires, said O-ring type tires having a surface engaging width approximating twenty-five thousands of an inch or less.

7. The arrow rest of claim 1 including adjusting means on said arrow rest carrier arranged to vary the spacing between said arrow rest members.

8. The arrow rest of claim 1 wherein said support bracket and linkage means extend longitudinally beyond the bow when attached thereto to form a overdraw for the bow.

9. The arrow rest of claim 1 including a laterally disposed hand guard mounted on said support frame with at least a portion of said hand guard disposed laterally outwardly of said arrow rest members.

10. An arrow rest for use on an archery bow to compensate for downward deflection of an arrow shaft during its acceleration by forward release of a bow string, and including;

a support bracket fixedly positioned at a shelf area of the bow, a base carried by the support bracket and having first upper and lower pivots on verticlly spaced transverse and horizontally disposed axes, a pair of upper and lower arms pivoted on and extending rearwardly from said first upper and lower pivots and one parallel with the other, a carrier supported by second upper and lower pivots engages with said upper and lower arms rearward from said first upper and lower pivots and spaced vertically on transverse horizontally disposed axes, a yieldable stop means on the base and comprised of a stop limiting upward pivotal movement of the arms and spring means permitting yieldable downward depression thereof, and guide means on the carrier to be engaged by and depressed by the arrow shaft deflected by forward release of a bow string.

11. The arrow rest as set forth in claim 10, wherein the pair of upper and lower arms are of equal length between the pivots therefor and wherein the vertical spacing of the pivots on the base is the same as the vertical spacing on the carrier.

12. The arrow rest as set forth in claim 10, wherein the stop of the yieldable stop means is an adjustment screw carried by the base and engaging one of said arms and thereby limiting said upward position of the carrier and, wherein the spring means of the yieldable stop means engages one of said arms for yieldable depression of the carrier.

13. The arrow rest as set forth in claim 10, wherein the guide means is at least one free turning wheel on a laterally disposed axis and having a center plane and supportably engaging the arrow shaft at said center plane and periphery of the wheel.

14. The arrow rest as set forth in claim 13, wherein the free turning wheel is carried by an arm adjustably secured to the carrier for placement of the wheel center plane coincidental with the arrow shaft axis.

15. The arrow rest as set forth in claim 13, wherein the wheel has a small cross section O-ring type tire for minimal engagement with the arrow shaft.

16. The arrow rest as set forth in claim 10, wherein the guide means is comprised of a pair of laterally spaced free turning wheels on angularly related laterally disposed axes and each wheel having a center plane and supportably engaging the arrow shaft at said center plane and periphery of the wheel, an arrow fletching passing between the wheels.

17. The arrow rest as set forth in claim 10, wherein the guide means is comprised of a pair of laterally spaced free turning wheels on angularly related laterally disposed axes and each wheel having a center plane substantially coincidental with and intersecting the axis of the arrow shaft and supportably engaging the arrow shaft at said center plane and periphery of the wheel, a fletching of the arrow passing between the wheels.

18. The arrow rest as set forth in claim 17, wherein the free turning wheels are each carried by an arm adjustably pivoted to the carrier to swing laterally for placement of the wheel center plane coincidental with the arrow shaft axis.

* * * * *